United States Patent [19]

Steeb

[11] Patent Number: 4,473,111

[45] Date of Patent: Sep. 25, 1984

[54] HEAT EXCHANGER

[76] Inventor: Dieter C. Steeb, Im Schönenbühl, Steinegg-Appenzell, Switzerland

[21] Appl. No.: 347,063

[22] Filed: Feb. 8, 1982

[30] Foreign Application Priority Data

Feb. 19, 1981 [DE] Fed. Rep. of Germany ..... 3106075

[51] Int. Cl.[3] ..... F28D 1/02

[52] U.S. Cl. ..... 165/153; 165/166; 165/DIG. 9

[58] Field of Search ..... 165/166, 153, 174

[56] References Cited

U.S. PATENT DOCUMENTS

| | | | |
|---|---|---|---|
| 3,252,510 | 5/1966 | Blankenhorn | 165/166 |
| 3,469,623 | 9/1969 | Rawlings | 165/166 |

FOREIGN PATENT DOCUMENTS

| | | | |
|---|---|---|---|
| 505969 | 9/1954 | Canada | 165/166 |
| 2036944 | 7/1980 | United Kingdom | 165/166 |
| 2093583 | 9/1982 | United Kingdom | 165/166 |
| 499490 | 5/1976 | U.S.S.R. | 165/166 |

*Primary Examiner*—William R. Cline
*Assistant Examiner*—John F. McNally
*Attorney, Agent, or Firm*—Hopgood, Calimafde, Kalil, Blaustein & Judlowe

[57] ABSTRACT

The invention contemplates an improved sandwich-type core construction for a heat exchanger, featuring light weight without sacrifice of the strength needed for handling elevated pressures. Passages of one set are interleaved with those of another set, using spaced parallel heat-transfer plates. Elongate parallel spacers extending in one direction establish, with their adjacent plates, flow passages of one system, while elongate parallel spacers extending in a different direction establish flow passage of a second system, between paired plates of the first system. The perimeter of the core at ends of at least one of the system passages establishes solid continuous seating for such system headers. Substantial weight saving, without sacrifice of strength, is achieved by depressed excavation of spacer material in regions thereof not involved in header-seating accommodation.

6 Claims, 3 Drawing Figures

HEAT EXCHANGER

BACKGROUND OF THE INVENTION

The present invention relates to a heat exchanger having sheet-metal plates in spaced pairs, each pair having rail-like spacers or cleats between laterally outer parallel longitudinal edges of the plates to keep them at fixed spacing from each other and to define, in each case, a flat inner flow passage between the plates, there being at least two systems of flow passages, and at least some of the flow passages being of U-shaped cross-section.

Prior art heat exchangers of the character indicated and having rail-like spacers of continuously rectangular cross-section are known from West German utility model (Gebrauchsmuster) No. 1,928,039. Such heat exchangers have the advantage that they can be very easily manufactured by stacking solder-clad metal sheets one above the other in sandwiching relation with interposed rail-like spacers, the sandwiched unit being then placed in a soldering bath or in a soldering oven where the parts then "bake together" to produce a solder-consolidated unit.

Heat exchangers of this kind, when applied, for example, as air/air coolers, find preferred use as intermediate coolers and as after-coolers for compressors, or as supercharged-air coolers for supercharged engines. When used as oil/air coolers, they may serve as oil coolers for screw-type compressors, hydraulic systems or the like, and as lubricating-oil coolers for internal combustion engines or other apparatus having a lubricating-oil circuit which is subjected to heat. In all of the indicated applications, it is desirable that the cooler be of least possible weight. This is particularly important in the case of coolers which are flanged on one side for mounting to an associated engine block, and where the rotational moment of inertia of the cooler must not exceed a given value.

Coolers of the aforementioned type in which the rail-like spacers are of U-shaped profile, with a U-shaped cross-section extending over their entire length, have been known since the turn of the century, namely, from French Pat. No. 350,382 and, later on, French Pat. No. 1,544,973. Using such U-shaped spacers, the weight of the heat exchanger can be reduced only at the expense of its strength; such U-shaped spacers are out of the question in any case in which elevated pressures and/or elevated external mechanical loads are to be expected.

BRIEF STATEMENT OF THE INVENTION

The object of the present invention is to create a heat exchanger of the character indicated which is light in weight and of substantially greater strength.

The invention achieves this object in a heat exchanger of the character indicated, by providing, for at least one flow passage, rail-like spacers or cleats of U-shaped cross-section in the form of shaped parts having an open depression or cavity on one side, the depression extending over the entire length of the spacer except for solid end walls at both ends of the spacer. Since the shaped parts having an open depression on one side are used as spacers of U-shaped cross-section, a substantial saving in weight is obtained.

With such spacer construction, particularly in the case of flow passages of relatively large cross section (such as are provided, for example, to accommodate the flow of air, wherein rails serving as spacers have relatively large dimensions), it is possible, as compared with solid spacers, to save up to 80 percent of the weight of the spacers without compromising strength requirements of the structure.

In applications in which the shaped parts are cold-extruded from light metal, one obtains, in addition to the desired advantage of a saving in weight, a substantial reduction in manufacturing cost due to a corresponding saving of material, which is particularly important with light metal, a relatively expensive material.

Particularly good strength properties of the structure are obtained if the depression-characterized shaped parts are so developed that end walls of the shaped parts are substantially thicker than other walls of these shaped parts, so that the outermost end regions of the shaped parts can be in solidly stacked array.

One particularly advantageous embodiment of the invention is characterized (1) by the fact that the spacers which are developed as shaped parts are provided in order to define outer limits of the flow passage of the one flow system for a first fluid, preferably cooling air, and are arranged with their depressions facing away from the flow passages, (2) by the fact that between flow passages of the first system, narrower flow passages of the second system are provided for a second fluid, advantageously a fluid which is to release heat and which has a flow direction oriented perpendicular to the flow direction of the first system, (3) by the fact that the two outermost flow passages are part of the first flow system and are limited laterally by spacers having closed outer surfaces which, together with the end walls of the depressions of other spacers of the first system, collectively form a solid frame-like seating surface for mounting an associated header. Such construction makes it possible for headers to be easily welded or soldered to the ends of the flow passages of the first flow system. If the rail-like spacers of the outermost flow passages of the first system are developed as elongate solid spacers having a rectangular cross section extending over their entire length, then these spacers form carriers which are rigidly supported at their ends by columns which are formed by the solid end walls of the depression-characterized intermediate spacers. The invention thus makes possible a heat exchanger of stable construction with a substantial saving of weight.

DETAILED DESCRIPTION

The invention will be illustratively described in detail in conjunction with the accompanying drawing, in which.

Figure 1:
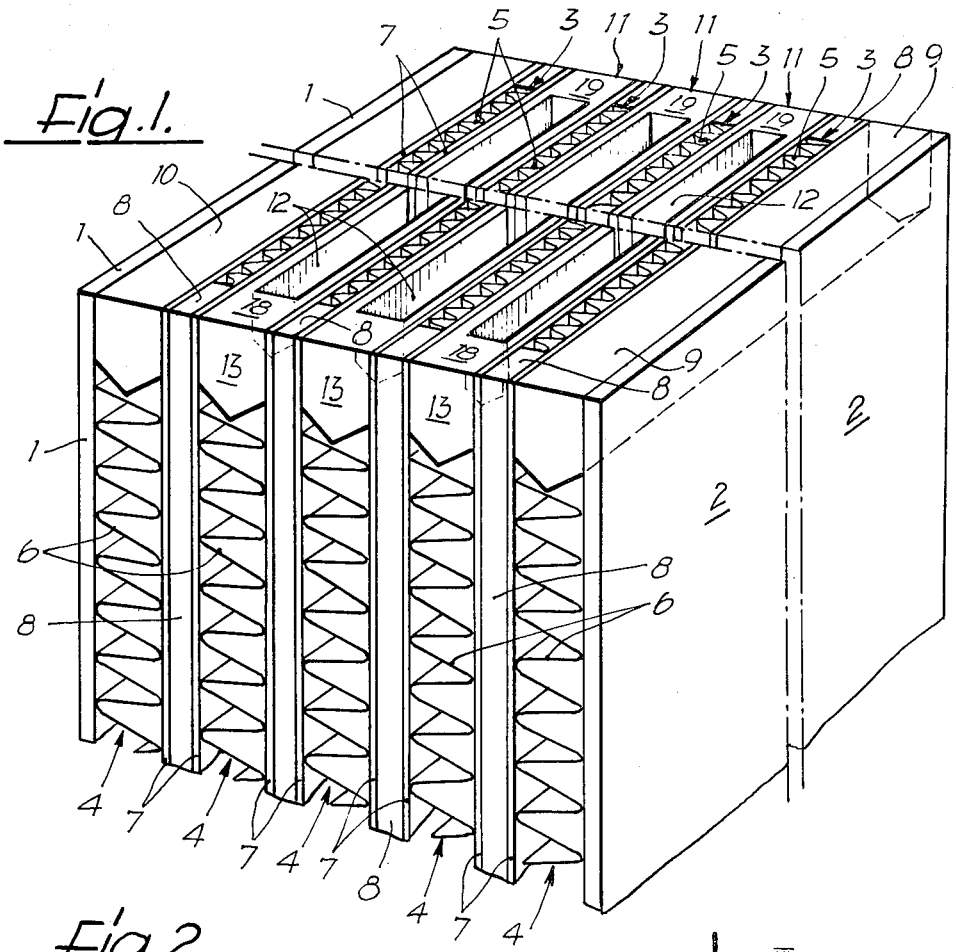
FIG. 1 is a fragmentary perspective view of a heat-exchanger core which is a consolidated stack of metal sheets and spacers for one embodiment of the invention, it being understood that headers at the ends of core passages have been omitted for a better showing of core detail.

FIG. 1 shows a heat-exchanger core having two solder-clad outer wall plates 1 and 2 in sandwiching relation to layers of a first flow system with horizontally extending flow passages 4, interlaced with layers of a second flow system which has vertically extending flow passages 3 of smaller cross-sectional area then the sectional area of flow passages 4 of the first system, the first-system passages 4 being intended for the passage of cooling air, and the second-system passages 3 being intended for the passage of a liquid medium. Within the flow spaces 3 and 4, corrugated sheet-metal fin-like members 5 and 6 subdivide flow passages of the respective systems into individual flow channels.

The outer wall plates 1 and 2 form the outer side-wall surfaces for the outermost flow passages 4 of the first system, and clad sheet-metal plates 7 of the same development are provided at intermediate planes parallel to the planes of the outer wall plates 1 and 2, thus establishing other sidewall surfaces which delineate the large-area surfaces of both the flow passages 3 of the second system and the flow passages 4 of the first system. The narrow sides of the flow passages are closed at their laterally outer edges by elongate rail-like members or cleats 8, 9, 10 and 11 of metallic material, inserted as spacers between the sheet-metal plates 7, these spacers being preferably of aluminum in the embodiment shown. Spacers 8 which define the narrow flow passages 3 are identical to each other and solid. Of the spacers which define the wider flow passages 4, only those of the two outer flow passages 4 are developed as solid spacers 9 and 10. The spacers 11 of the other (intermediate) flow passages 4, on the other hand, are developed as shaped parts, of shape to be explained in further detail with particular reference to FIGS. 2 and 3.

Figure 2:
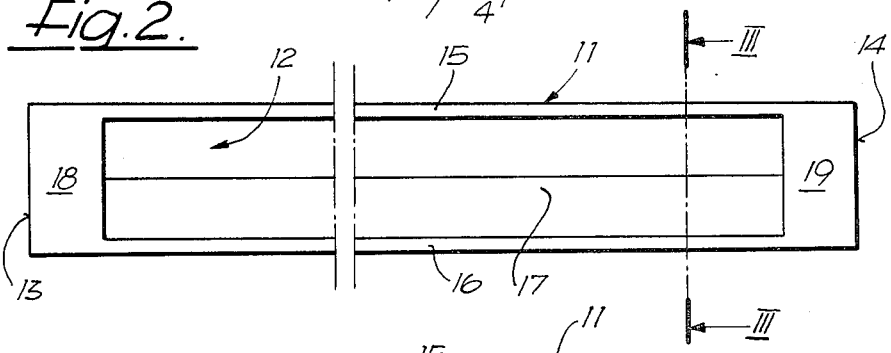
FIG. 2 is an enlarged fragmentary top view of a rail-like spacer developed as a depressed or trough-shaped part of the embodiment of FIG. 1.
Figure 3:
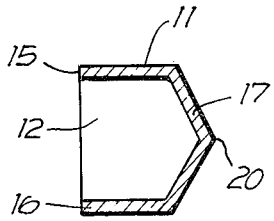
FIG. 3 is a sectional view taken at the line III—III of FIG. 2.

As can be noted from FIGS. 1 to 3, the shaped parts forming intermediate spacers 11 have a depression or cavity 12 which extends practically over the entire length of these spacers and is outwardly open, i.e., open at the side opposite the side which limits the flow passage 4; a trough-shaped configuration thus results for the shaped part 11. The depression 12 terminates a distance short of outer-end surfaces 13 and 14 of the shaped part. This distance is substantially greater than the thickness of walls 15 and 16 defining spaced sides of the depression 12, and is also substantially greater than the thickness of the bottom 17 of the depression 12, so that relatively thick end walls having correspondingly large edge surfaces 18 and 19 are formed in the region of the respective end surfaces 13 and 14.

As can be particularly noted from FIG. 3, the bottom 17 is of gable-roof shape, so that linear contact is established between ridge 20 of bottom 17 and the adjacent sheet-metal fin 6 of the corresponding flow passage 4. Each of the spacers 9 and 10 is developed as a solid part of the outermost flow passages 4 and is of correspondingly contoured shape, differing from the spacers 11 merely by the absence of the depression 12.

The presence of depression 12 will be seen to effect a substantial saving in the weight of spacers 11 as compared with the weight of the solid spacers 9 and 10. The use of solid spacers 9 and 10 at the outermost flow passages 4 is, however, advisable for the mounting of headers to the ends of passages of the second system. Such headers, not shown in the drawing, will be understood to provide manifolding chambers which communicate with flow passages 3 and have inlet and outlet connection means for directing fluid flow through the passages 3. The use of solid spacers 9 and 10 provides a continuous (i.e., not interrupted by a depression ) frame-shaped seating surface for corresponding end surfaces of the header thereby accommodated. Due to the fact that the depressions 12 of spacers 11 between the spacers 9 and 10 do not extend to the solid-support region of the end surfaces 13 and 14 (being terminated a distance offset therefrom so as to form wide edge surfaces 18 and 19), the seating surface also continues without interruption in the region of the spacers 11. Between individual spacers 11, the end regions of the spacers 8, together with adjacent edge regions of the sheet-metal plates 7, assure the peripherally continuous solid-frame nature of this seating surface. Surfaces at the ends of the second flow system of flow passages 3 therefore provide effectively a continuous flat surface, establishing a wide mounting frame to which the corresponding header can be easily applied by soldering or welding.

Although spacers 8 of flow passages 4 of the first flow system have all been shown as solid bars, it will be understood that all intermediate spacers 8 may, as with intermediate spacers 11, alternatively be developed as trough-shaped parts with an outwardly open depression, in order to effect a further saving in weight, without sacrifice of overall strength.

What is claimed is:

1. A heat-exchanger package comprising a stacked plurality of rectangular sheet-metal plates and elongate solid prismatic spacers the longitudinal ends of which have planar end faces which are orthogonal to the elongate direction of said spacers, said spacers holding said sheet-metal plates apart from each other so as to form first and second orthogonally related systems of low passages, with said systems in stacked interlace; first pairs of said spacers arranged parallel to each other and in register with first pairs of opposed edges of said plates to define flow passages of said first system, second pairs of said spacers arranged parallel to each other and orthogonal to said spacers of said first pairs and in register with second pairs of opposed edges of said plates to define flow passages of said second system so that only said ends of the spacers of said first pairs are in register with only the ends of the spacers of said second pairs; said first system including outermost first-flow passages forming outermost flow passages of said package and intermediate first-flow passages between said outermost flow passages, so that each of said second-flow passages lies between two of said first-flow passages; each of the spacers of said first pairs having an outer longitudinal surface facing an outer side of said package, said outer surfaces of the outermost first pairs of spacers being continuous and there being at least one pair of first-pair spacers intermediate said outermost first-pair spacers, the spacers of said at least one intermediate first pair being characterized by an elongate trough-like recess which is open to the involved outer side of said package and which extends along said intermediate first-pair spacers and terminates a distance short of said end faces so that said recess is defined (a) by longitudinal side and bottom walls extending along said recess and (b) by two end walls which are thicker than said side and bottom walls and which register with said ends of said second-pair spacers; whereby spaced peripherally continuous massive frames are collectively defined (1) by said outermost first-pair spacers, (2) by the longitudinal ends of said recessed first-pair spacers, (3) by the longitudinal ends of said second-pair spacers and (4) by parts of said plates in register with said ends of said spacers, each of said frames having an effectively continuous essentially flat outer surface for efficient header connection to the respective ends of the second flow passages.

2. The heat-exchanger package of claim 1, in which the recessed spacers are of U-shaped section in the recessed region thereof.

3. The heat-exchanger package of claim 2, in which the bottom of the recessed region is of roof shape.

4. The heat-exchanger package of claim 1 or claim 3, in which the recessed spacers are cold-extruded from light metal.

5. A heat-exchanger package comprising a stacked plurality of rectangular sheet-metal plates and elongate solid prismatic spacers the longitudinal ends of which have planar end faces which are orthogonal to the elongate direction of said spacers, said spacers holding the sheet-metal plates apart from each other so as to form first and second orthogonally related systems of flow passages, with said systems in stacked interlace; first pairs of said spacers arranged parallel to each other and in register with first pairs of opposed edges of said plates to define said first-system flow passages, second pairs of said spacers arranged parallel to each other and orthogonal to said first-pair spacers and in register with second pairs of opposed edges of said plates to define second-system flow passages so that only said ends of the spacers of said first pairs are in register with only the ends of the spacers of said second pairs; said first system including outermost first-flow passages forming outermost flow passages of said package and intermediate first-flow passages between said outermost flow passages, so that each of said second-flow passages lies between two of said first-flow passages; each of the spacers of said first pairs having an outer longitudinal surface facing an outer side of said package, said outer surfaces of the outermost first pairs of spacers being continuous; whereby spaced peripherally continuous massive frames are collectively defined (1) by said outermost first-pair spacers, (2) by the longitudinal ends of said second-pair spacers and (3) by parts of said plates lying between said ends of said spacers, each of said frames having an essentially flat outer surface for efficient header connection to the respective ends of the second flow passages.

6. A heat-exchanger package comprising a stacked plurality of rectangular sheet-metal plates and elongate solid prismatic spacers the longitudinal ends of which have planar end faces which are orthogonal to the elongate direction of said spacers, said spacers holding said sheet-metal plates apart from each other so as to form first and second orthogonally related systems of flow passages, with said systems in stacked interlace; first pairs of said spacers arranged parallel to each other and in register with first pairs of opposed edges of said plates to define said first-system flow passages, second pairs of said spacers arranged parallel to each other and orthogonal to said first-pair spacers and in register with second pairs of opposed edges of said plates to define second-system flow passages so that only said ends of the spacers of said first pairs are in register with only the ends of the spacers of said second pairs; said first system including outermost first-flow passages forming outermost flow passages of said package, so that at least one second-flow passage lies between two of said first-flow passages; each of the spacers of said first pairs having an outer longitudinal surface facing an outer side of said package, said outer surfaces of said outermost first pairs of spacers being continuous; whereby spaced peripherally continuous massive frames are collectively defined (1) by said outermost first-pair spacers, (2) by the longitudinal ends of said second-pair spacers and (3) by parts of said plates lying between said ends of said spacers, each of said frames having an effectively continuous essentially flat outer surface for efficient header connection to the respective ends of the second flow passages.

* * * * *